United States Patent [19]

Aoki et al.

[11] 4,427,767

[45] Jan. 24, 1984

[54] COLOR PHOTOGRAPHIC SENSITIVE MATERIALS

[75] Inventors: Kozo Aoki; Yoshio Seoka, both of Minami-ashigara, Japan

[73] Assignee: Fuji Photo Film Co., Ltd., Kanagawa, Japan

[21] Appl. No.: 447,365

[22] Filed: Dec. 6, 1982

[30] Foreign Application Priority Data

Dec. 7, 1981 [JP] Japan ..... 56-196676

[51] Int. Cl.[3] ..... G03C 1/40

[52] U.S. Cl. ..... 430/552; 430/549; 430/553

[58] Field of Search ..... 430/552, 553, 549, 384, 430/385

[56] References Cited

U.S. PATENT DOCUMENTS

| | | | |
|---|---|---|---|
| 3,446,622 | 5/1969 | Magagnoli et al. | 430/552 |
| 3,758,308 | 9/1973 | Beavers et al. | 430/553 |
| 3,880,661 | 4/1975 | Lau et al. | 430/553 |
| 4,333,999 | 6/1982 | Lau | 430/384 |

FOREIGN PATENT DOCUMENTS

| | | | |
|---|---|---|---|
| 1011940 | 12/1965 | United Kingdom | 430/552 |

*Primary Examiner*—J. Travis Brown

*Attorney, Agent, or Firm*—Sughrue, Mion, Zinn, Macpeak and Seas

[57] ABSTRACT

A silver halide color photographic sensitive material is disclosed. The material is comprised of a substrate having a silver halide emulsion layer position thereon and a cyan dye forming coupler. The coupler is reresented by the general formula (I):

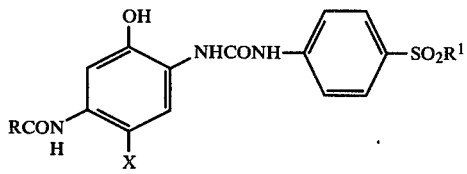

(I)

wherein R represents a substituted or nonsubstituted alkyl group, aryl group or heterocyclic group, X represents a group capable of releasing by an oxidative coupling reaction with a developing agent, and $R^1$ represents a substituted or nonsubstituted alkyl group or aryl group. The coupler of the invention can be easily dissolved in a high boiling point organic solvent and makes possible production of a light sensitive material having a high dye forming rate, high maximum color density and good fastness to light. Furthermore, the couplers prevent a large decrease in density when the bleaching solution utilized has a weak oxidation ability.

6 Claims, No Drawings

COLOR PHOTOGRAPHIC SENSITIVE MATERIALS

FIELD OF THE INVENTION

The present invention relates to color photographic sensitive materials containing a novel cyan dye forming coupler.

BACKGROUND OF THE INVENTION

When a silver halide photographic sensitive material is subjected to color development after exposed to light, an oxidized aromatic primary amine developing agent reacts with dye forming couplers to form dye images. Generally, in this process, a color reproduction process by a subtractive process is used, wherein dye images of yellow, magenta and cyan which are complement colors of blue, green and red are formed in order to reproduce blue, green and red. As the cyan dye image forming coupler, phenols and naphthols have often been used. However, color images obtained from phenols or naphthols used hitherto have many problems in preservability. For example, color images obtained from 2-acylaminophenol cyan couplers described in U.S. Pat. Nos. 2,367,531 and 2,423,730 have generally inferior fastness to heat, color images obtained from 2,5-diacylaminophenol cyan couplers described in U.S. Pat. Nos. 2,369,929 and 2,772,162 have generally inferior fastness to light, and 1-hydroxy-2-naphthamide cyan couplers are generally insufficient with respect to their fastness to both heat and light.

On the other hand, phenol cyan couplers having a ureido group in 2-position thereof described in U.S. Pat. Nos. 3,446,622, 3,996,253, 3,758,308 and 3,880,661 and Japanese Patent Application (OPI) No. 65134/81 (the term "OPI" as used herein refers to a "published unexamined Japanese patent application") are said to have good fastness to light as compared with the above described conventional cyan couplers. However, their fastness is not sufficient for preserving for a long period of time. Further, many of these couplers are not desirable because they easily crystallize out when added to the photographic emulsion, due to their low solubility in high boiling point organic solvents.

SUMMARY OF THE INVENTION

An object of the present invention is to improve the above described faults and to provide color photographic sensitive materials using cyan dye forming couplers which have good fastness to light and which easily dissolve in high boiling point organic solvents.

Another object of the present invention is to provide couplers having a high dye forming rate and a high maximum color density in the color developer and, particularly, in a color developer free from benzyl alcohol, and, on the other hand, to provide couplers which hardly cause deterioration of the density when processed with a bleaching solution having weak oxidation ability or a fatigued bleaching solution.

The objects of the present invention are attained by providing couplers represented by the following general formula (I) and silver halide color sensitive materials containing the above described coupler:

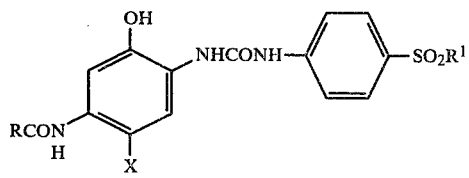

(I)

wherein R represents a substituted or nonsubstituted alkyl group, aryl group or heterocyclic group, X represents a group capable of releasing by an oxidative coupling reaction with a developing agent, and $R^1$ represents a substituted or nonsubstituted alkyl group or aryl group.

DETAILED DESCRIPTION OF THE INVENTION

In the following R, X and $R^1$ in the general formula (I) are illustrated in detail.

In the general formula (I), R represents a chain or cyclic alkyl group having preferably 1 to 22 carbon atoms (for example, a methyl group, butyl group, pentadecyl group or cyclohexyl group, etc.), an aryl group (for example, a phenyl group or naphthyl group, etc.) or a heterocyclic group (for example, a 2-pyridyl group, 4-pyridyl group, 2-furanyl group, 2-oxazolyl group or 2-imidazolyl group, etc.), which may be substituted by substituents selected from alkyl groups, aryl groups, heterocyclic groups, alkoxy groups (for example, methoxy group, dodecyloxy group and 2-methoxyethoxy group, etc.), aryloxy groups (for example, phenoxy group, 2,4-di-tert-amylphenoxy group, 3-tert-butyl-4-hydroxyphenoxy group and naphthyloxy group, etc.), carboxy group, carbonyl groups (for example, acetyl group, tetradecanoyl group and benzoyl group, etc.), ester groups (for example, methoxycarbonyl group, phenoxycarbonyl group, acetoxy group, benzoyloxy group, butoxysulfonyl group and toluenesulfonyloxy group, etc.), amide groups (for example, acetylamino group and methanesulfonylamide group, etc.), carbamoyl group (for example, ethylcarbamoyl group, etc.), sulfamoyl group (for example, butylsulfamoyl group, etc.), imide groups (for example, succinimide group and hydantoinyl group, etc.), sulfonyl groups (for example, methanesulfonyl group), hydroxy group, cyano group, nitro group and halogen atoms.

In the general formula (I), X represents a hydrogen atom, a halogen atom (for example, a fluorine atom, chlorine atom or bromine atom, etc.) or another group capable of releasing. Examples of the group capable of releasing represented by X include alkoxy groups (for example, ethoxy group, dodecyloxy group, methoxyethylcarbamoylmethoxy group, carboxymethoxy group and methylsulfonylethoxy group, etc.), aryloxy groups (for example, phenoxy group, naphthyloxy group and 4-carboxyphenoxy group, etc.), acyloxy groups (for example, acetoxy group, tetradecanoyloxy group and benzoyloxy group, etc.), sulfonyloxy groups (for example, methanesulfonyloxy group and toluenesulfonyloxy group, etc.), amide groups (for example, dichloroacetylamino group, heptafluorobutyrylamino group, methanesulfonylamino group and toluenesulfonylamino group, etc.), alkoxycarbonyloxy groups (for example, ethoxycarbonyloxy group, benzyloxycarbonyloxy group, etc.), aryloxycarbonyloxy groups (for example, phenoxycarbonyloxy group, etc.), and imide groups (for example, succinimide group and hydantoinyl group, etc.).

In the general formula (I), $R^1$ represents a chain or cyclic alkyl group having preferably 1 to 22 carbon atoms (for example, a methyl group, butyl group, dodecyl group or cyclohexyl group, etc.) or an aryl group (for example, phenyl group or naphthyl group, etc.), which may be substituted by the substituents described in R.

The compounds represented by the general formula (I) (hereinafter referred to as coupler of the present invention) have an acylamino group in 5-position of the phenol and a ureido group in 2-position, and they are characterized by that said ureido group has a group defined in the general formula (I), such as $-SO_2R^1$ as a substituent. It is believed that many good characteristics are obtained by the introduction of such a group.

Namely, the couplers of the present invention have good solubility in high boiling point organic solvents, good dispersion stability in photographic emulsions, good spectral absorption characteristic and good transparency. Further, color images obtained from couplers of the present invention have excellent preservability, namely, excellent fastness to heat and light, and the couplers of the present invention are characterized by showing a small reduction in density when processed with a bleaching solution having weak oxidation ability or a fatigued bleaching solution.

On the other hand, couplers of the present invention have not been disclosed in U.S. Pat. Nos. 3,446,622, 3,996,253, 3,758,308 and 3,880,661 and Japanese Patent Application (OPI) No. 65134/81 in which arts concerned with the above described known cyan couplers are described. Accordingly, the effects shown by the couplers of the present invention are quite surprising.

In the following, preferred examples of couplers included in the scope of the present invention are described, but the couplers of the present invention are not restricted to them.

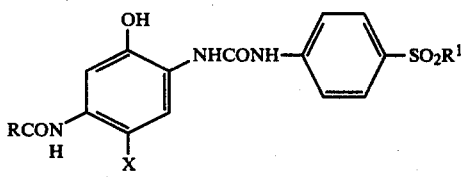

| Coupler No. | R | X | $R^1$ |
|---|---|---|---|
| 1 | 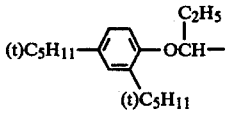 | —H | $-CH_3$ |
| 2 | 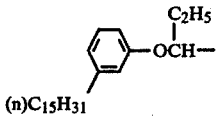 | —H | $-CH_3$ |
| 3 | 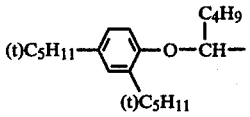 | —Cl | $-C_4H_9$ |
| 4 | 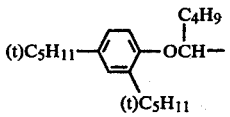 | —H | $-CH_3$ |
| 5 | 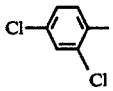 | —Cl | $-C_{12}H_{25}$ |
| 6 | 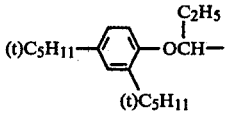 | $-OCH_2CH_2SO_2CH_3$ | $-CH_3$ |
| 7 | 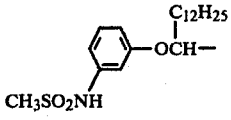 | —Cl | $-CH_3$ |

-continued

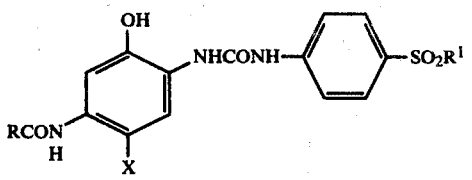

| Coupler No. | R | X | R1 |
|---|---|---|---|
| 8 | 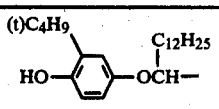 | —H | —CH3 |
| 9 | 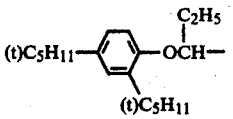 | —H | 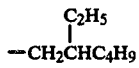 |
| 10 | 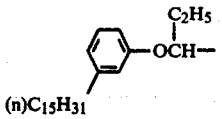 | —H | 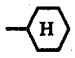 |
| 11 | 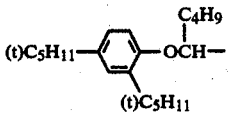 | —H | —CH2CH2OCH3 |
| 12 | 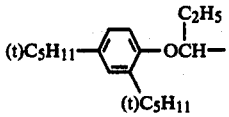 | —H | 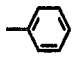 |
| 13 | 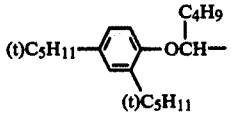 | —Cl | 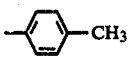 |
| 14 | 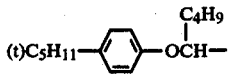 | —H | 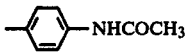 |

In the following, typical examples for synthesizing couplers of the present invention are described.

SYNTHESIS 1

Synthesis of Coupler (1)

(i) Synthesis of 2-(4-methylsulfonylphenylureido)-5-nitrophenol 19.3 g of 4-methylsulfonylaniline was dissolved in a mixture of 60 ml of tetrahydrofuran and 11 ml of pyridine, and 19.8 g of phenyl chloroformate was added dropwise under cooling with ice. After stirred for 30 minutes, the mixture was poured into iced water containing 12 ml of hydrochloric acid, and the precipitated crystals were separated by filtration and dried to obtain 32.8 g of the product.

32.8 g of the resulting crystals, 17.9 g of 2-amino-5-nitrophenol and 0.8 g of imidazole were suspended in xylene, and the resulting suspension was refluxed with heating for 3 hours. After being cooled, the precipitated crystals were separated by filtration and dried to obtain 33.5 g of the desired compound.

(ii) Synthesis of Coupler (1)

32 g of 2-(4-methylsulfonylphenylureido)-5-nitrophenol obtained in (i), 30 g of reduced iron and 2 g of ammonium chloride were added to a mixture of 200 ml of isopropanol and 20 ml of water, and the resulting mixture was refluxed for 3 hours with heating. After being cooled, 5.5 g of sodium hydroxide dissolved in 10 ml of water was added thereto, and the iron powder was filtered off. The filtrate was neutralized with acetic acid, and the precipitated crystals were separated by filtration and dried to obtain 16.2 g of the product.

14.6 g of the resulting crystals were dissolved in 100 ml of acetonitrile. 16.9 g of 2-(2,4-di-tert-phenoxy)butanoyl chloride was added dropwise under refluxing with heating, and the mixture was refluxed for 2 hours. After being cooled, the mixture was poured into water and extracted with ethyl acetate. After being washed with water, the solvent was removed by distillation under a reduced pressure. The resulting oily product was crystallized from acetonitrile to obtain 20.0 g of the desired coupler (melting point: 129°–131° C.).

Elementary analysis value (%) C: 65.21, H: 7.03, N: 6.91. Calculation value (%) C: 65.46, H: 7.27, N: 6.74.

Other couplers could be synthesized by the same process as used for Coupler (1).

The couplers of the present invention are added generally in an amount of $2\times10^{-3}$ mol to $5\times10^{-1}$ mol and, preferably $1\times10^{-2}$ mol to $5\times10^{-1}$ mol per mol of silver in the emulsion layer.

Photographic emulsions produced using the coupler of the present invention may contain color image forming couplers other than couplers of the present invention. Examples of some preferred couplers which can be used with couplers of the invention include nondiffusible couplers having a hydrophobic group called a ballast group in the molecule. The couplers may be any of the 4-equivalent type ones or 2-equivalent type ones with respect to silver ions. Further, the emulsions may contain colored couplers which have the effect of color correction or couplers which release a development inhibitor during development (the so-called DIR coupler). The couplers may be those which yield a colorless product by a coupling reaction.

The yellow forming couplers used may be known ring-opened ketomethylene type couplers. Among them, benzoylacetanilide type compounds and pivaloylacetanilide type compounds are advantageous to use. Examples of useful yellow forming couplers include those described in U.S. Pat. Nos. 2,875,057, 3,265,506, 3,408,194, 3,551,155, 3,582,322, 3,725,072 and 3,891,445, German Pat. No. 1,547,868, German Patent Applications (OLS) Nos. 2,219,917, 2,261,361 and 2,414,006, British Pat. No. 1,425,020, Japanese Patent Publication No. 10783/76 and Japanese Patent Applications (OPI) Nos. 26133/72, 73147/73, 102636/76, 6341/75, 123342/75, 130442/75, 21827/76, 87650/75, 82424/77 and 115219/77, etc.

The magenta forming couplers used may be pyrazolone compounds, indazolone compounds and cyanoacetyl compounds and, pyrazolone compounds are particularly advantageous. Examples of magenta forming couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German Patent Applications (OLS) Nos. 2,408,665, 2,417,945, 2,418,959 and 2,424,467, Japanese Patent Publication No. 6031/65 and Japanese Patent Applications (OPI) Nos. 20826/76, 58922/77, 129538/74, 74027/74, 159336/75, 42121/77, 74028/74, 60233/75, 26541/76 and 55122/78, etc.

The cyan forming couplers used may be phenol compounds and naphthol compounds such as those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German Patent Applications (OLS) Nos. 2,414,830 and 2,454,329 and Japanese Patent Applications Nos. (OPI) 59838/73, 26034/76, 5055/73, 146828/76, 69624/77 and 90932/77.

Useful colored couplers include those described in U.S. Pat. Nos. 3,476,560, 2,521,908 and 3,034,892, Japanese Patent Publications Nos. 2016/69, 22335/63, 11304/67 and 32461/69, Japanese Patent Applications (OPI) Nos. 26034/76 and 42121/77 and German Patent Application (OLS) No. 2,418,959.

Examples of useful DIR couplers include those described in U.S. Pat. Nos. 3,227,554, 3,617,291, 3,701,783, 3,790,384 and 3,632,345, German Patent Applications (OLS) Nos. 2,414,006, 2,454,301 and 2,454,329, British Pat. No. 953,454, Japanese Patent Applications (OPI) Nos. 69624/77 and 122335/74 and Japanese Patent Publication No. 16141/76.

The sensitive materials may contain compounds which release a development inhibitor by development besides the DIR couplers. For example, it is possible to use those described in U.S. Pat. Nos. 3,297,445 and 3,379,529, German Patent Application (OLS) No. 2,417,914 and Japanese Patent Applications (OPI) Nos. 15271/77 and 9116/78.

Two or more of the above described couplers may be contained in the same layer. The same coupler may be contained in different two or more layers.

In order to introduce the above described couplers into silver halide emulsion layers, known methods such as described in U.S. Pat. No. 2,322,027, etc., can be used. For example, the couplers may be dispersed in a hydrophilic colloid after they are dissolved in alkyl phthalates (dibutyl phthalate or dioctyl phthalate, etc.), phosphoric acid esters (diphenyl phosphate, triphenyl phosphate, tricresyl phosphate or dioctylbutyl phosphate), citric acid esters (for example, tributyl acetylcitrate), benzoic acid esters (for example, octyl benzoate), alkylamides (for example, diethyl laurylamide) or aliphatic acid esters (for example, dibutoxyethyl succinate or dioctyl azerate), etc., or organic solvents having a boiling point of about 30° C. to 150° C. such as lower alkyl acetates (such as ethyl acetate or butyl acetate), ethyl propionate, secondary butyl alcohol, methyl isobutyl ketone, $\beta$-ethoxyethyl acetate or methyl cellosolve acetate, etc. The above described high boiling point organic solvents and low boiling point organic solvents may be used as a mixture of them.

Further, it is possible to use a method for dispersing with polymers as described in Japanese Patent Publication No. 39853/76 and Japanese Patent Application (OPI) No. 59943/76.

When the couplers have acid groups such as carboxylic acid or sulfonic acid, they are introduced into the hydrophilic colloid as an aqueous alkaline solution.

The sensitive materials produced by the present invention may contain ultraviolet ray absorbing agents in a hydrophilic colloid layer. For example, it is possible to use benzotriazole compounds substituted by an aryl group (for example, those described in U.S. Pat. No. 3,533,794), 4-thiazolidone compounds (for example, those described in U.S. Pat. Nos. 3,314,794 and 3,352,681), benzophenone compounds (for example, those described in Japanese Patent Application (OPI) No. 2784/71), cinnamic acid esters (for example, those described in U.S. Pat. Nos. 3,705,805 and 3,707,375), butadiene compounds (for example, those described in U.S. Pat. No. 4,045,229) and benzoxazole compounds (for example, those described in U.S. Pat. No. 3,700,455). Further, it is possible to use those described in U.S. Pat. No. 3,499,762 and Japanese Patent Application (OPI) No. 48535/79. Ultraviolet ray absorbing couplers (for example, $\alpha$-naphthol type cyan dye forming couplers) and ultraviolet ray absorbing polymers may be used. These ultraviolet ray absorbing agents may be mordanted in a specific layer.

The photographic emulsions used in the present invention can be prepared by processes described in P. Glafkides, *Chimie et Physique Photographique* (issued by Paul Montel Co., 1967), G. F. Duffin, *Photographic Emulsion Chemistry* (issued by The Focal Press, 1966) and V. L. Zelikman et al., *Making and Coating Photo-*

*graphic Emulsion* (issued by The Focal Press, 1964), etc. It is possible to use any acid process, neutral process or ammonia process. Further, for reacting soluble silver salts with soluble halogen salts, it is possible to use any one-side mixing process, simultaneous mixing process or a combination thereof.

It is also possible to use a process for forming particles in the presence of excess silver ions (the so-called reversal mixing process). The simultaneous mixing process used may be a process in which the pAg of the liquid phase of forming silver halide is kept at a constant value such as the so-called controlled double jet process.

According to this process, silver halide emulsions having regular crystal form and nearly uniform particle size can be obtained.

Two or more silver halide emulsions which are prepared respectively may be used as a mixture.

Cadmium salts, zinc salts, lead salts, thallium salts, iridium salts or complex salts thereof, rhodium salts or complex salts thereof, or iron salts or iron complex salts, etc., may be coexistent in the step of formation of silver halide particles or physical ageing.

Gelatin may be advantageously used as the binder or protective colloid for the photographic emulsions, but other hydrophilic colloids can be used.

For example, it is possible to use proteins such as gelatin derivatives, graft polymers of gelatin with other high polymers, albumin or casein, etc.; saccharose derivatives such as cellulose derivatives such as hydroxyethyl cellulose, carboxymethyl cellulose or cellulose sulfate, etc., sodium alginate or starch derivatives, etc.; and various synthetic high molecular substances such as homo- or copolymers such as polyvinyl alcohol, polyvinyl alcohol partial acetal, poly-N-vinyl pyrrolidone, polyacrylic acid, polymethacrylic acid, polyacrylamide, polyvinyl imidazole or polyvinyl pyrazole, etc.

The gelatin used may be lime-treated gelatin, acid-treated gelatin or enzyme-treated gelatin as described in *Bull. Soc. Sci. Phot. Japan,* No. 16, page 30 (1966). In addition, it is possible to use hydrolyzed products and enzymatic decomposition products of gelatin. Examples of useful gelatin derivatives include those obtained by reacting gelatin with various compounds, for example, acid halides, acid anhydrides, isocyanates, bromoacetic acid, alkane sultones, vinylsulfonamides, maleinimides, polyalkylene oxides and epoxy compounds. Examples of these derivatives are described in U.S. Pat. Nos. 2,614,928, 3,132,945, 3,186,846 and 3,312,553, British Pat. Nos. 861,414, 1,033,189 and 1,005,784, and Japanese Patent Publication No. 26845/67, etc.

It is possible to use graft polymers of gelatin obtained by grafting homo- or copolymers of vinyl monomers such as acrylic acid, methacrylic acid, derivatives of them such as esters or amides, etc., acrylonitrile or styrene, etc., on gelatin. Particularly, it is preferred to use graft polymers composed of gelatin and a polymer having a certain degree of compatibility with gelatin, for example, a polymer of acrylic acid, methacrylic acid, acrylamide, methacrylamide or hydroxyalkyl methacrylate, etc. Examples of them have been described in U.S. Pat. Nos. 2,763,625, 2,831,767 and 2,956,884.

Examples of typical synthetic hydrophilic high molecular substances include those described in German Patent Application (OLS) No. 2,312,708, U.S. Pat. Nos. 3,620,751 and 3,879,205, and Japanese Patent Publication No. 7561/68.

In the photographic emulsions used in the present invention, various compounds can be incorporated in order to prevent fogging in the step of producing sensitive materials, during preservation or during photographic processing or to stabilize photographic properties. Namely, it is possible to add various compounds known as antifogging agents or stabilizers such as azoles, for example, benzothiazolium salts, nitroindazoles, nitrobenzimidazoles, chlorobenzimidazoles, bromobenzimidazoles, mercaptothiazoles, mercaptobenzothiazoles mercaptobenzimidazoles, mercaptothiazoles, aminotriazoles, benzotriazoles, nitrobenzotriazoles and mercaptotetrazoles (particularly, 1-phenyl-5-mercaptotetrazole), etc.; mercaptopyrimidines; mercaptotriazines; thioketo compounds such as oxazolinethione; azaindenes such as triazaindenes, tetraazaindenes (particularly, 4-hydroxy substituted-(1,3,3a,7)tetraazaindenes) or pentaazaindenes, etc.; benzenethiosulfonic acid; benzenesulfinic acid; or benzenesulfonamides, etc. For example, it is possible to use compounds described in U.S. Pat. Nos. 3,954,474 and 3,982,947 and Japanese Patent Publication No. 28660/77.

The photographic emulsion layers of the photographic sensitive material of the present invention may contain polyalkylene oxides or derivatives thereof such as ethers, esters or amines, etc., thioether compounds, thiomorpholines, quaternary ammonium salt compounds, urethane derivatives, urea derivatives, imidazole derivatives or 3-pyrazolidone derivatives, etc., for the purpose of increasing sensitivity, increasing contrast or accelerating development. For example, it is possible to use those described in U.S. Pat. Nos. 2,400,532, 2,423,549, 2,716,062, 3,617,280, 3,772,021 and 3,808,003 and British Pat. No. 1,488,991, etc.

The photographic emulsions used in the present invention may be sprectrally sensitized by methine dys or others. Examples of dyes used include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. In these dyes, it is possible to utilize nuclei which are conventionally utilized for cyanine dyes as basic heterocyclic nuclei. Namely, it is possible to utilize a pyrroline nucleus, an oxazoline nucleus, a thiazoline nucleus, a purrole nucleus, an oxazole nucleus, a thiazole nucleus, a selenazole nucleus, an imidazole nucleus, a tetrazole nucleus and a pyridine nucleus, etc., nuclei wherein an alicyclic hydrocarbon ring fuses to the above described nuclei, and nuclei wherein an aromatic hydrocarbon ring fuses to the above described nuclei, such as an indolenine nucleus, a benzoindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus, etc. These nuclei may have substitutents on the carbon atoms.

In merocyanine dyes or composite merocyanine dyes, it is possible to utilize 5- or 6-member heterocyclic nuclei such as a pyrazolin-5-one nucleus, a thiohydantoin nucleus, a 2-thioxazolidin-2,4-dione nucleus, a thiazolidine-2,4-dione nucleus, a rhodanine nucleus or a thiobarbituric acid nucleus, etc., as nuclei having a ketomethylene structure.

Examples of useful sensitizing dyes include those described in German Patent No. 929,080, U.S. Pat. Nos.

2,231,658, 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes may be used alone, but they can be used as a combination of them. Combinations of sensitizing dyes are frequently used for the purpose of, particularly, supersensitization. Typical examples of them have been described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78 and Japanese Patent Application (OPI) Nos. 110618/77 and 109925/77.

The emulsions may contain dyes which do not have a spectral sensitization function or substances which do not substantially absorb visible rays and have a supersensitization function together with the sensitizing dyes. For example, they may contain aminostilbene compounds substituted by nitrogen containing heterocyclic groups (for example, those described in U.S. Pat. Nos. 2,933,390 and 3,635,721), aromatic organic acid-formaldehyde condensation product (for example, those described in U.S. Pat. No. 3,743,510), cadmium salts or azaindene compounds, etc. Combinations described in U.S. Pat. Nos. 3,615,613, 3,615,641, 3,617,295 and 3,635,721 are particularly useful.

The sensitive materials produced according to the present invention may contain water-soluble dyes in the hydrophilic colloid layers as filter dyes or for the purpose of preventing irradiation or others. Examples of such dyes include oxonol dyes, hemioxonol dyes, styryl dyes, merocyanine dyes, cyanine dyes and azo dyes. Particularly, oxonol dyes, hemioxonol dyes and merocyanine dyes are useful. Examples of dyes which can be used include those described in British Pat. Nos. 584,609 and 1,177,429, Japanese Patent Application (OPI) Nos. 85130/73, 99620/74, 114420/74 and 108115/77 and U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In the sensitive materials produced according to the present invention, the photographic emulsion layers and other hydrophilic colloid layers may contain whitening agents such as stilbene, triazine, oxazole or coumarin type whitening agents. These whitening agents may be water-soluble. Further, water-insoluble whitening agents may be used as a dispersion. Examples of fluorescent whitening agents have been described in U.S. Pat. Nos. 2,632,701, 3,269,840, 3,359,102 and British Pat. Nos. 852,075 and 1,319,763, etc.

In carrying out the present invention, the following known antifading agents may be used together, and color image stabilizers may be used alone or as a combination of two or more of them. Examples of known antifading agents include hydroquinone derivatives described in U.S. Pat. Nos. 2,360,290, 2,418,613, 2,675,314, 2,701,197, 2,704,713, 2,728,659, 2,732,300, 2,735,765, 2,710,801 and 2,816,028 and British Pat. No. 1,363,921, gallic acid derivatives described in U.S. Pat. Nos. 3,457,079 and 3,069,262, etc., p-alkoxyphenols described in U.S. Pat. Nos. 2,735,765 and 3,698,909 and Japanese Patent Publication Nos. 20977/74 and 6623/77, p-oxyphenol derivatives described in U.S. Pat. Nos. 3,432,300, 3,573,050, 3,574,627 and 3,764,337 and Japanese Patent Application (OPI) Nos. 35633/77, 147434/77 and 152225/77, and bisphenols described in U.S. Pat. No. 3,700,455, etc.

The sensitive materials produced according to the present invention may contain anti-color-fogging agents such as hydroquinone derivatives, aminophenol derivatives, gallic acid derivatives and ascorbic acid derivatives. Examples of them have been described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146233/77, and Japanese Patent Publication No. 23813/75, etc.

The present invention can be applied to multilayer multicolor photographic materials having at least two layers each having a different spectral sensitivity on a base. Multilayer natural color photographic sensitive materials generally have at least a red-sensitive emulsion layer, a green-sensitive emulsion layer and a blue-sensitive emulsion layer on a base. The order of these layers can be suitably selected as occasion demands. Generally, the red-sensitive emulsion layer contains a cyan forming coupler, the green-sensitive emulsion layer contains a magenta forming coupler, and the blue-sensitive emulsion layer contains a yellow forming coupler. If desired, other combinations can be utilized.

In order to carry out photographic processing of the sensitive materials of the present invention, any of known processes can be utilized. Known processing solutions can be used. The processing temperature is usually selected from a range from 18° C. to 50° C., but a temperature lower than 18° C. or a temperature higher than 50° C. may be used. Development processing for forming silver image (black-and-white photographic processing) or color photographic processing comprising development for forming color images can be adopted according to the purpose.

The color developer generally comprises an alkaline aqueous solution containing a color developing agent. Examples of useful color developing agents include known primary aromatic amine developing agents, for example, phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline, etc.).

Further, compounds described in L. F. A. Mason, *Photographic Processing Chemistry*, pages 226–229 (issued by Focal Press, 1966), U.S. Pat. Nos. 2,193,015 and 2,592,364 and Japanese Patent Application (OPI) No. 64933/73, etc., may be used.

In addition, the color developer may contain pH buffer agents such as sulfites, carbonates, borates and phosphates of alkali metals, and development inhibitors or antifogging agents such as bromides, iodides or organic antifoggants, etc. If desired, it may contain water softeners, preservatives such as hydroxylamine, organic solvents such as benzyl alcohol or diethylene glycol, development accelerators such as polyethylene glycol, quaternary ammonium salts or amines, dye forming couplers, competitive couplers, fogging agents such as sodium borohydride, auxiliary developing agents such as 1-phenyl-3-pyrazolidone, viscosity increasing agents, polycarboxylic acid chelating agents described in U.S. Pat. No. 4,083,723, and antioxidants described in German Patent Application (OLS) No. 2,622,950, etc.

Photographic emulsion layers after color development are generally subjected to bleaching. The bleaching may be carried out simultaneously with fixation or may be carried out respectively. Examples of useful bleaching agents include compounds of polyvalence metals such as iron (III), cobalt (III), chromium (VI) or copper (II), peracids, quinones and nitroso compounds. For example, it is possible to use ferricyanides, bichromates, organic complex salts of iron (III) or cobalt (III), for example, complex salts of aminopolycarboxylic acids such as ethylenediaminetetraacetic acid, nitrilotriacetic acid or 1,3-diamino-2-propanol tetraacetic acid, etc., or organic acids such as citric acid, tartaric acid or malic acid, etc., persulfates, permanganates and nitrosophenol, etc. Among them, potassium ferricyanide, sodium ethylenediaminetetraacetato iron (III) complex and ammonium ethylenediaminetetraacetato iron (III) complex are particularly useful. Ethylenediaminetetraacetato iron (III) complexes are useful for both a bleaching solution and one-bath bleach-fixing solution.

To the bleaching solution or the bleach-fixing solution, it is possible to add bleach accelerators described in U.S. Pat. Nos. 3,042,520 and 3,241,966 and Japanese Patent Publication Nos. 8506/70 and 8836/70, etc., thiol compounds described in Japanese Patent Application (OPI) No. 65732/78, and other various additives.

In the following, the present invention is illustrated in detail with reference to examples, but the present invention is not limited to them.

EXAMPLE

A solution obtained by heating a mixture of 31 g of Coupler (1) of the present invention, 31 g of trioctyl phosphate and 50 ml of ethyl acetate to 50° C. was added to 250 ml of an aqueous solution containing 25 g of gelatin and 1.0 g of sodium dodecylbenzenesulfonate with stirring, and the mixture was then previously heated and allowed to pass 5 times through a colloid mill to obtain a finely dispersed emulsion.

The resulting emulsion was all added to 1.0 kg of a photographic emulsion containing 54 g of silver iodobromide and 60 g of gelatin. After adding 80 ml of a 2% aqueous solution of 4,6-dichloro-4-hydroxytriazine as a hardener, the pH of the mixture was adjusted to 6.0, and the mixture was applied to a triacetyl cellulose film base so as to result in a dry film thickness of 7.0 microns. This is named Sample A.

Films were prepared by the same procedure as described above, except that the same molar amounts of Couplers (2) and (4) were used instead of the Coupler (1). The resulting films are named Samples B and C.

For comparison, films were prepared by the same procedure as described above, except that the same molar amounts of Comparative Couplers (101), (102) and (103) were used instead of the Coupler (1). The resulting films are named Samples D, E and F.

Comparative Coupler (101):

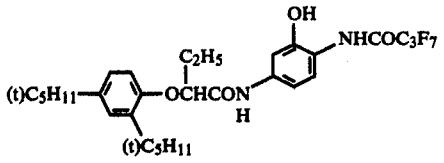

Comparative Coupler (102): (U.S. Pat. No. 3,996,253)

-continued

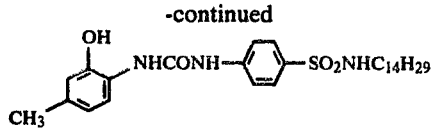

Comparative Coupler (103):
(Japanese Patent Application (OPI) 65134/81)

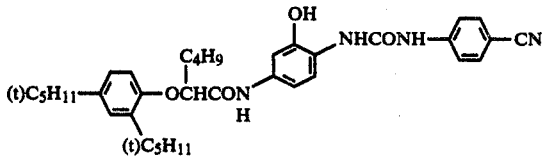

These films were exposed to light through a wedge for sensitometry and processed as follows.

| Color Development Processing Step | | |
|---|---|---|
| 1. Color development | 33° C. | 3 min 30 sec |
| 2. Bleach-fixation | 33° C. | 1 min 30 sec |
| 3. Water wash | 25–30° C. | 2 min 30 sec |

Each processing solution for the color development processing step had the following composition.

| Color Developer: | |
|---|---|
| Benzyl alcohol | 15 ml |
| Diethylene glycol | 8 ml |
| Ethylenediaminetetraacetic acid | 5 g |
| Sodium sulfite | 2 g |
| Anhydrous potassium carbonate | 30 g |
| Hydroxylamine sulfate | 3 g |
| Potassium bromide | 0.6 g |
| 4-Amino-N—ethyl-N—(β-methanesulfonamidoethyl)-m-toluidine sesquisulfate monohydrate | 5 g |
| Water to make 1 liter | pH 10.2 |
| **Bleach-Fixing Solution:** | |
| Ethylenediaminetetraacetic acid | 2 g |
| Ethylenediaminetetraacetato ferric complex | 40 g |
| Sodium sulfite | 5 g |
| Ammonium thiosulfate | 70 g |
| Water to make | 1 l |

The optical density to red light of each of the samples was measured after being processed and the results are shown in Table 1.

TABLE 1

| Film Sample | Coupler | Gamma | Maximum Density |
|---|---|---|---|
| A | (1) (the present invention) | 2.82 | 2.63 |
| B | (2) (the present invention) | 2.66 | 2.52 |
| C | (4) (the present invention) | 2.74 | 2.58 |
| D | (101) (comparison) | 2.46 | 2.12 |
| E | (102) (comparison) | 2.22 | 2.32 |
| F | (103) (comparison) | 2.14 | 2.29 |

The fastness of each film after being developed was then examined. Fastness of the sample which was allowed to stand in the dark at 100° C. for 6 days, that of the sample which was allowed to stand in the dark at 60° C. under 70% RH for 6 weeks and that of the sample which was exposed to light for 6 days with a xenon tester (100,000 luxes) were shown in Table 2. The reduction rates of the density are all based on an initial density of 1.0.

TABLE 2

| Film Sample | Coupler | 100° C. 6 days (%) | 60° C., 70% RH 6 Weeks (%) | Light (Xenon) 6 Days (%) |
|---|---|---|---|---|
| A | (1) (the present invention) | 0 | 2 | 3 |
| B | (2) (the present invention) | 1 | 3 | 4 |
| C | (4) (the present invention) | 0 | 1 | 6 |
| D | (101) (comparison) | 18 | 14 | 41 |
| E | (102) (comparison) | 78 | 11 | 32 |
| F | (103) (comparison) | 5 | 8 | 9 |

The results clearly show that the cyan couplers of the present invention not only have good color forming ability (high maximum density and high gamma) but also excellent fastness.

When emulsions obtained by emulsifying Couplers (1), (2) and (4) together with oil and gelatin were allowed to stand in a water bath at 40° C. for 8 hours, precipitation of crystals was not observed. Accordingly, it is understood that these couplers show good dispersibility.

While the invention has been described in detail and with reference to specific embodiments thereof, it will be apparent to one skilled in the art that various changes and modifications can be made therein without departing from the spirit and scope thereof.

What is claimed is:

1. Silver halide color photographic sensitive materials containing a cyan dye forming coupler represented by the general formula (I):

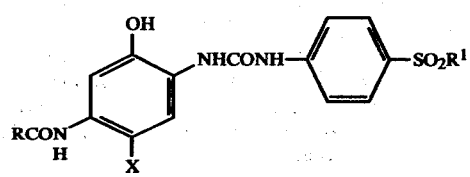

(I)

wherein R represents a substituted or nonsubstituted alkyl group, aryl group or heterocyclic group, X represents a group capable of releasing by an oxidative coupling reaction with a developing agent, and $R^1$ represents a substituted or nonsubstituted alkyl group or aryl group.

2. A silver halide color photographic sensitive material as claimed in claim 1, wherein R is a chain or cyclic alkyl group containing 1 to 22 carbon atoms.

3. A silver halide color photographic sensitive material as claimed in claim 1, wherein X represents a hydrogen atom or a halogen atom.

4. A silver halide color photographic sensitive material as claimed in claim 1, wherein $R^1$ represents a chain or cyclic alkyl group containing 1 to 22 carbon atoms.

5. A silver halide color photographic sensitive material as claimed in claim 1, wherein the material is comprised of a plurality of silver halide emulsion layers.

6. A silver halide color photographic sensitive material as claimed in claim 1, wherein the material is further comprised of additional color image forming couplers.

* * * * *